US010133238B2

(12) United States Patent
Semon et al.

(10) Patent No.: US 10,133,238 B2
(45) Date of Patent: Nov. 20, 2018

(54) MONOLITHIC TIMEPIECE REGULATOR, TIMEPIECE MOVEMENT AND TIMEPIECE HAVING SUCH A TIMEPIECE REGULATOR

(71) Applicant: LVMH Swiss Manufactures SA, La Chaux-de Fonds (CH)

(72) Inventors: Guy Semon, Neuchatel (CH); Wouter Pieter Van Zoest, Delft (NL); Nima Tolou, The Hague (NL)

(73) Assignee: LVMH SWISS MANUFACTURES SA, La Chaux-de Fondsm (CH)

( * ) Notice: Subject to any disclaimer, the term of this patent is extended or adjusted under 35 U.S.C. 154(b) by 0 days.

(21) Appl. No.: 15/526,493

(22) PCT Filed: Nov. 16, 2015

(86) PCT No.: PCT/EP2015/076716
§ 371 (c)(1),
(2) Date: May 12, 2017

(87) PCT Pub. No.: WO2016/079068
PCT Pub. Date: May 26, 2016

(65) Prior Publication Data

US 2017/0322517 A1 Nov. 9, 2017

(30) Foreign Application Priority Data

Nov. 17, 2014 (EP) ..... 14193516

(51) Int. Cl.
*G04B 17/10* (2006.01)
*G04B 17/04* (2006.01)

(52) U.S. Cl.
CPC ..... *G04B 17/10* (2013.01); *G04B 17/04* (2013.01)

(58) Field of Classification Search
CPC ..... G04B 17/10; G04B 17/04; G04B 17/20; G04B 17/26; G04B 17/28; G04B 17/285; G04B 13/02; G04B 13/025
(Continued)

(56) References Cited

U.S. PATENT DOCUMENTS

2005/0217169 A1* 10/2005 Kunz ..... G04B 13/025 47/33
2007/0237035 A1* 10/2007 Helfer ..... F16D 41/069 368/147

(Continued)

FOREIGN PATENT DOCUMENTS

EP 2273323 A2 1/2011
EP 2645189 A1 10/2013

OTHER PUBLICATIONS

International Search Report related to Application No. PCT/EP2015/076716 dated May 1, 2016.

*Primary Examiner* — Edwin A. Leon
(74) *Attorney, Agent, or Firm* — Miller, Matthias & Hull LLP

(57) ABSTRACT

Monolithic timepiece regulator made in a single plate, having an external rigid element, an internal rigid element, and elastic suspensions connecting the external rigid element to the internal rigid element and enabling oscillatory rotating movements between them. The internal rigid element has arms which are rigidly connected with one another, leaving between each other free angular spaces, and the elastic suspensions are located in these free angular spaces.

16 Claims, 5 Drawing Sheets

(58) Field of Classification Search
USPC ..... 368/170, 124–128, 164–168, 171
See application file for complete search history.

(56) References Cited

U.S. PATENT DOCUMENTS

| | | | | |
|---|---|---|---|---|
| 2013/0176829 | A1 | 7/2013 | Cusin et al. | |
| 2013/0188461 | A1* | 7/2013 | Mallet ..... | G04B 17/063 368/173 |
| 2015/0043313 | A1 | 2/2015 | Stranczl et al. | |
| 2015/0063082 | A1 | 3/2015 | Stranczl et al. | |

* cited by examiner

MONOLITHIC TIMEPIECE REGULATOR, TIMEPIECE MOVEMENT AND TIMEPIECE HAVING SUCH A TIMEPIECE REGULATOR

CROSS-REFERENCE TO RELATED APPLICATION

This Application is a 35 USC § 371 US National Stage filing of International Application No. PCT/EP2015/076716 filed on Nov. 16, 2015, and claims priority under the Paris Convention to European Patent Application No. 14193516.3 filed on Nov. 17, 2014.

FIELD OF THE DISCLOSURE

The invention relates to monolithic timepiece regulators, to timepiece movements and timepieces having such regulators.

BACKGROUND OF THE DISCLOSURE

Document US2013176829A1 discloses a monolithic timepiece regulator made in a single plate, comprising:

an external rigid element, an internal rigid element surrounded by said external rigid element, a plurality of elastic suspensions connecting the external rigid element to the internal rigid element and enabling oscillating rotational movements between the external rigid element to the internal rigid element, around an axis of rotation which is perpendicular to the plate.

This oscillating mechanism has two separate internal rigid elements, each connected to the external rigid element by elastic suspensions. One problem of such design is that when fixing the two internal elements on a common support, deformations and stresses are created in the elastic suspensions, thus modifying the characteristics of the oscillator and in particular its frequency or its rotation axis, which is not suitable.

SUMMARY OF THE DISCLOSURE

One objective of the present invention is to at least mitigate this drawback.

To this end, according to an embodiment of the invention, the internal rigid element comprises a plurality of arms which are rigid with one another, said arms being distributed on 360 deg. and leaving between them free angular spaces which are radially external to the internal rigid element, and the elastic suspensions are respectively located in said free angular spaces.

In various embodiments of the mechanism according to the invention, one may possibly have recourse in addition to one and/or other of the following arrangements:

said plurality of elastic suspensions includes at least three elastic suspensions and said plurality of arms includes at least three arms;

said plurality of elastic suspensions consists in three elastic suspensions and said plurality of arms consists in three arms;

said elastic suspensions are regularly distributed angularly around the axis of rotation;

said internal rigid element further includes a rigid hub, said arms of the internal rigid element extending each from said hub to an outer end relatively close to the external rigid element;

each elastic suspension includes a plurality of elastic branches which are disposed substantially radially with regard to the axis of rotation and which extend each between an inner end and an outer end, said elastic branches being connected together either at their respective inner ends, or at their respective outer ends;

each elastic suspension comprises at least one first elastic branch and at least two second elastic branches, said first elastic branch having an outer end connected to the external rigid element and an inner end connected to a rigid intermediate element separate from the internal rigid element, the two second elastic branches having inner ends connected to said intermediate rigid element and outer ends connected respectively to two adjacent arms of the internal rigid element;

each elastic suspension comprises at least one first elastic branch, at least two second elastic branches, at least two third elastic branches and at least two fourth elastic branches, said first elastic branch having an outer end connected to the external rigid element and an inner end connected to a first rigid intermediate element separate from the internal rigid element, the two second elastic branches having inner ends connected to said first intermediate rigid element and outer ends connected respectively to two outer arms of a V-shaped, second rigid intermediate element, said second rigid intermediate element being separate from the internal rigid element and from the first rigid intermediate element and having a base disposed between the first rigid intermediate element and the axis of rotation, the two third elastic branches having outer ends connected to said second intermediate rigid element and inner ends connected respectively to a third rigid intermediate element, said third rigid intermediate element being separate from the internal rigid element and from the first and second rigid intermediate elements and being disposed between the second rigid intermediate element and the axis of rotation, the two fourth elastic branches having inner ends connected to said third intermediate rigid element and outer ends connected respectively to adjacent arms of the internal rigid element;

the arms of the inner rigid element are T shaped and include an outer head extending in a substantially angular direction relative to the axis of rotation, said outer head having two ends connected respectively to outer ends of two elastic branches of two adjacent elastic suspensions;

the monolithic timepiece regulator has an off-axis stiffness of at least 60 N/m;

the monolithic timepiece regulator has a rotational stiffness of at most 5 $10^{-4}$ Nm/rad.

Besides, the invention also concerns a timepiece movement having a monolithic timepiece regulator as defined above.

In various embodiments of the timepiece movement according to the invention, one may possibly have recourse in addition to one and/or other of the following arrangements:

the internal rigid element is fixed to a support and the external rigid element is free to oscillate around the axis of rotation, with respect to the support;

the external rigid element is fixed to a support and the internal rigid element is free to oscillate around the axis of rotation, with respect to the support;

one of the internal and external rigid elements is fixed to a support and the other one of the internal and external rigid elements is a regulating member which is free to oscillate around the axis of rotation, the timepiece movement further comprising a blocking mechanism which is controlled by the regulating element to regularly and alternatively hold and release a rotary energy distribution wheel so that said energy distribution wheel rotates by rotational steps, of a constant angular travel at each rotational step, said escapement mechanism being further adapted to regularly release energy to the regulating member for maintaining oscillation of said regulating member.

Further, the invention also concerns timepieces having a timepiece movement as defined above.

BRIEF DESCRIPTION OF THE DRAWINGS

Other features and advantages of the invention appear from the following detailed description of one embodiment thereof, given by way of non-limiting example, and with reference to the accompanying drawings.

In the drawings.

DETAILED DESCRIPTION OF THE DISCLOSURE

In the Figures, the same references denote identical or similar elements.

Figure 1:
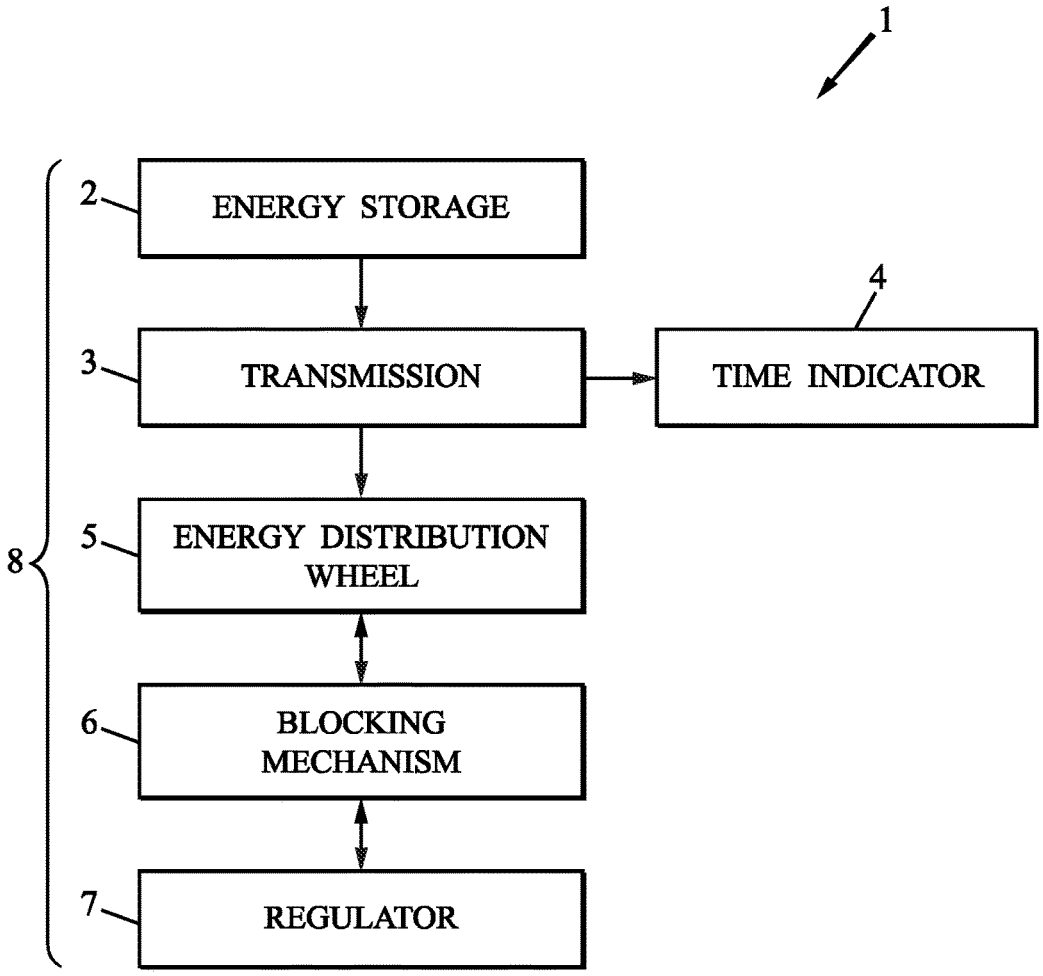
FIG. 1 is a schematic bloc diagram of a mechanical timepiece.

FIG. 1 shows a schematic bloc diagram of a mechanical timepiece 1, for instance a watch, including at least the following:

- a mechanical energy storage 2;
- a transmission 3 powered by the energy storage 2;
- one or several time indicator(s) 4, for instance watch hands driven by the transmission 3;
- an energy distribution wheel 5 driven by the transmission 3;
- a blocking mechanism 6 adapted for sequentially hold and release the energy distribution wheel;
- a regulator 7, which is an oscillating mechanism controlling the blocking mechanism to move it regularly in time so that the hold and release sequence of the blocking mechanism be of constant duration, thus giving the tempo of the movement of the energy distribution wheel 5, the transmission 3 and the time indicators 4.

The mechanical energy storage 2 is usually a spring, for instance a spiral shaped spring usually called mainspring. This spring may be wound manually through a winding stem and/or automatically through an automatic winding powered by the movements of the user.

The transmission 3 usually is a gear comprising a series of gear wheels (not shown) meshing with one another and connecting an input shaft to an output shaft (not shown). The input shaft is powered by the mechanical energy storage 2 and the output shaft is connected to the energy distribution wheel. Some of the gear wheels are connected to the watch hands or other time indicators 4.

The energy distribution wheel 5 may be for instance an escape wheel and the blocking mechanism may be for instance pallets as known in the art, e.g. a set of Swiss pallets or detent pallets cooperating with the escape wheel in the usual way. This example is of course not limitative.

The transmission 3 is designed so that the energy distribution wheel rotates much more quickly than the input shaft (with a speed ratio which may be for instance of the order of 3000).

The regulator 7 will be described in more details below. It is designed to oscillate with a constant frequency, thus ensuring the timepiece's precision. The oscillation of the regulator is sustained by regular transfers of mechanical energy from the energy distribution wheel 5, for instance through the blocking mechanism 6.

The mechanical energy storage 2, a transmission 3, energy distribution wheel 5, blocking mechanism 6 and regulator 7 form together a timepiece movement 8.

Figure 2:
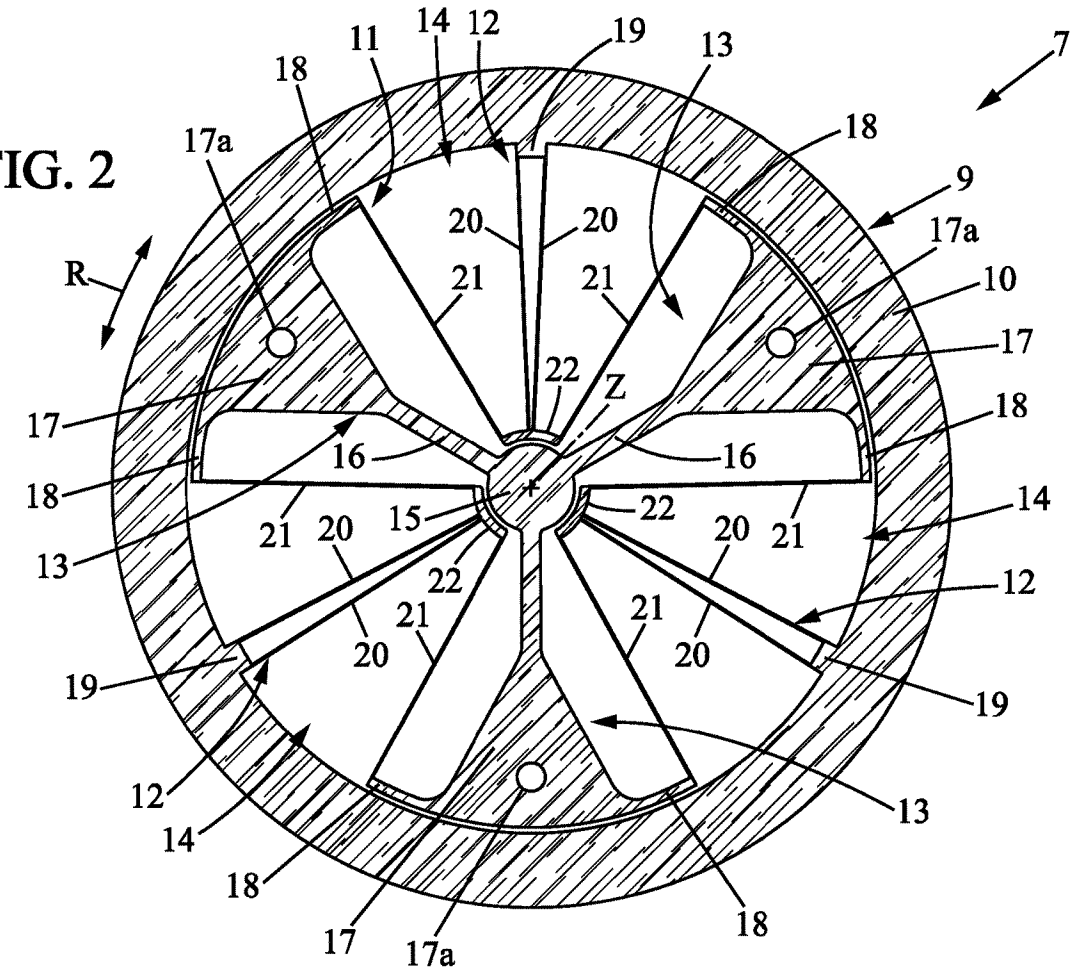
FIG. 2 is a plan view of a regulator for a mechanical timepiece, according to a first embodiment of the invention, in neutral position.

According to the invention, the regulator 7 is monolithic and made in a single plate 9, as shown for instance in FIG. 2. Plate 9 is usually planar.

The plate 9 may have a small thickness, e.g. about 0.1 to about 0.6 mm, depending of the material thereof.

The plate 9 may have transversal dimensions, in the plane of said plate (e.g. width and length, or diameter), comprised between about 15 mm and 40 mm.

The plate 9 may be manufactured in any suitable material, preferably having a relatively high Young modulus to exhibit good elastic properties. Examples of materials usable for plate 9 are: silicon, nickel, steel, titanium. In the case of silicon, the thickness of plate 9 may be for instance comprised between 0.5 and 0.6 mm.

The various members of the regulator 7, which will be detailed hereafter, are formed by making cutouts in plate 9. These cutouts may be formed by any manufacturing method known in micromechanics, in particular for the manufacture of MEMS.

In the case of a silicon plate 9, plate 9 may be locally hollowed out for instance by Deep Reactive Ion Etching (DRIE), or in some cases by solid state laser cutting (in particular for prototyping or small series).

In the case of a nickel plate 9, regulator 7 may be obtained for instance by LIGA.

In the case of a steel or titanium plate 9, plate 9 may be locally hollowed out for instance by Wire Electric Discharge Machining (WEDM).

The constituting parts of regulator 7, each formed portions of plate 9, by will now be described in details.

In all embodiments, regulator 7 comprises:

- an external (i.e. outer) rigid element 10,
- an internal (i.e. inner) rigid element 11 surrounded by said external rigid element 10,
- a plurality of elastic suspensions 12 connecting the external rigid element 10 to the internal rigid element 11 and enabling oscillating rotational movements between the external rigid element and the internal rigid element, around an axis of rotation Z which is perpendicular to the plate 9. The axis of rotation Z may be slightly movable, since there may be off axis movements between the internal and external rigid elements due to gravity or acceleration of shock.

The external rigid element 10 may have an annular shape, i.e. a closed shape surrounding a hollow space, either substantially circular or other. In possible variants, external rigid element 10 may surround internal rigid element 11 only partially, i.e. not on 360 deg.

The difference between so-called rigid parts and so-called elastic parts is their rigidity in the plane of plate 9, due to their shape and in particular to their slenderness. Slenderness may be measured for instance by the slenderness ratio (ratio of length of the part on width of the part). Parts of high slenderness are elastic (i.e. elastically deformable) and parts of low slenderness are rigid. For instance, so-called rigid parts may have a rigidity in the plane of plate 9, which is at least about 1000 times higher than the rigidity of so-called elastic parts in the plane of plate 9.

The internal rigid element 11 comprises a plurality of rigid arms 13 which are rigidly connected with one another.

The arms 13 are distributed on 360 deg. and leave between them free angular spaces 14 which are radially external to the internal rigid element 11.

For instance, the internal rigid element 11 may also include a rigid central hub 15 formed in one piece with the arms 13. The arms 13 may extend substantially radially outwardly from the central hub 15.

In the example of FIG. 2, the arms 13 are 3 and evenly distributed at 120 deg. from each other, and the elastic suspensions 12 are also 3, distributed at 120 deg. from each other. More generally, the arms 13 are at least 2 and the elastic suspensions 12 are in the same number as the arms 13.

The arms 13 may be wider at their radially outer end compared to their radially inner end. More specifically, in the example of FIG. 2, each arm 13 may include a radially inner portion 16 of relatively small width and a radially outer diverging portion 17 having a width which increases radially outwardly. The outer diverging portions 17 may have respective holes 17*a*. In the example of FIG. 2, the internal rigid element 11 is designed to be fixed to a support S (shown only schematically in FIG. 3) in the timepiece 1, for instance by screws or similar through the holes 17*a*, and the external rigid element 11 is designed to freely oscillate in rotation around the axis of rotation Z, in the direction of arrows R. The rigid external element 10 is thus here constituting an inertial regulator member which controls the above-mentioned blocking mechanism. During these oscillations, the suspensions 12 bias the rigid external element 10 toward a neutral position, shown in FIG. 2.

It should be noted that the configuration of the regulator may be reversed, with the rigid internal element being fixed and the rigid external element being pivoting in oscillations.

The radially outer end of the arm 13 may be extended laterally, by two opposite lateral extensions 18, so that each arm 13 is T-shaped, the outer end of the arm 13, including the lateral extensions, forming an outer head extending in a substantially angular direction relative to the axis of rotation Z.

The inside rim of the rigid external element 10 is preferably circular and centered on the axis of rotation Z, and the outer rim of each arm 13, including possible lateral extensions 18, are also circular and centered on the axis of rotation Z. A small clearance is left between the outer rim of each arm 13 and the inner rim of the rigid external element 10, for instance of the order of 0.1 mm.

The rigid external element 10 may possibly include protrusions 19 extending radially inwardly from the inner rim of said rigid external element 10. These protrusions 19 may serve as stop members cooperating with the lateral extensions 18 to limit the angular oscillations of the rigid external element 10 relative to the rigid inner element 11. In the example shown in FIG. 2, protrusions 19 are disposed at mid-distance between the arms 13. For instance, each protrusion may be separated from adjacent arms by approximately 30 deg.

The elastic suspensions 12 are respectively located in said free angular spaces 14 between the arms 13.

Preferably, each elastic suspension 12 includes a plurality of elastic branches which are disposed substantially radially with regard to the axis of rotation and which extend each between an inner end and an outer end, said elastic branches being connected together either at their respective inner ends, or at their respective outer ends.

In the example of FIG. 2, each elastic suspension 12 comprises at least one first elastic branch 20 and at least two second elastic branches 21. The first elastic branch 20 has an outer end connected to the external rigid element 10 and an inner end connected to a rigid intermediate element 22 separate from the internal rigid element 11, while the two second elastic branches 21 having inner ends connected to said intermediate rigid element 22 and outer ends connected respectively to two adjacent arms 13 of the internal rigid element.

The length of elastic branches 20, 21 may be comprised between for instance 8 and 13 mm.

The width of elastic branches 20, 21 may be comprised between 0.02 and 0.03 mm, for instance around 0.025 mm.

The same order of magnitude of lengths and widths may apply to other elastic branches of the elastic suspensions 12, in other embodiments.

The elastic suspension 12 may include two first elastic branches 20.

The outer ends of the first elastic branches 20 may be connected to the protrusions of the rigid external element 10.

The outer ends of the second elastic branches 21 may be connected respectively to the free ends of the lateral extensions 18, which avoids interference between said elastic branches 21 and arms 13.

The intermediate rigid elements 22 may be shaped as arcs of circle centered on the axis of rotation Z and disposed around the rigid hub 15, which may also have a circular shape. The clearance between rigid elements 22 and hub 15 may be small, e.g. about 0.1 mm.

The above regulator may have an oscillation frequency of e.g. about 15 to 30 Hz when made out of silicon.

The amplitude of oscillation may be up to around 20 deg. while keeping good properties of linearity and thus good precision in time measurement. In particular, the amplitude of oscillation may be up to 13 deg. while keeping excellent time precision, with maximum time deviation per day of less than 6 s.

In a particular example of the embodiment of FIG. 2, regulator 7 may exhibit the following properties:

material of plate 9: silicon;

thickness of plate 9: 0.525 mm;

inner diameter of rigid external element 10: 24 mm;

outer diameter of rigid external element 10: 29 mm;

width of elastic branches 20, 21: 0.024 mm;

rotational stiffness of the regulator: $k_r$=1.37 $10^{-4}$ Nm/rad ($k_r$ is such that, when a torque T is applied to the movable inertial regulating member—here external rigid element 10—around the rotation axis Z, said movable inertial regulating member turns from its rest position of an angle ω such that $T=k_r \cdot \omega$);

minimum off-axis stiffness $k_{oa}$ of the regulator: 181 N/m ($k_{oa}$ is such that, when a force F is applied to the movable inertial regulating member—here external rigid element 10—in the plane of plate 9, said movable inertial regulating member is shifted from its rest position of a distance d such that $F=k_{oa}\cdot d$).

The above described regulator has a number of advantages over the prior art and in particular over US2013176829A1:

- the intrinsic properties of the regulator, in particular time period of the oscillations and positioning of the axis of rotation, is not sensitive to mounting of the regulator in a timepiece movement;
- the mutual disposition of the rigid external and internal elements enable a relatively large amplitude of oscillations without interference between these elements and with good linearity properties.

Figure 3:
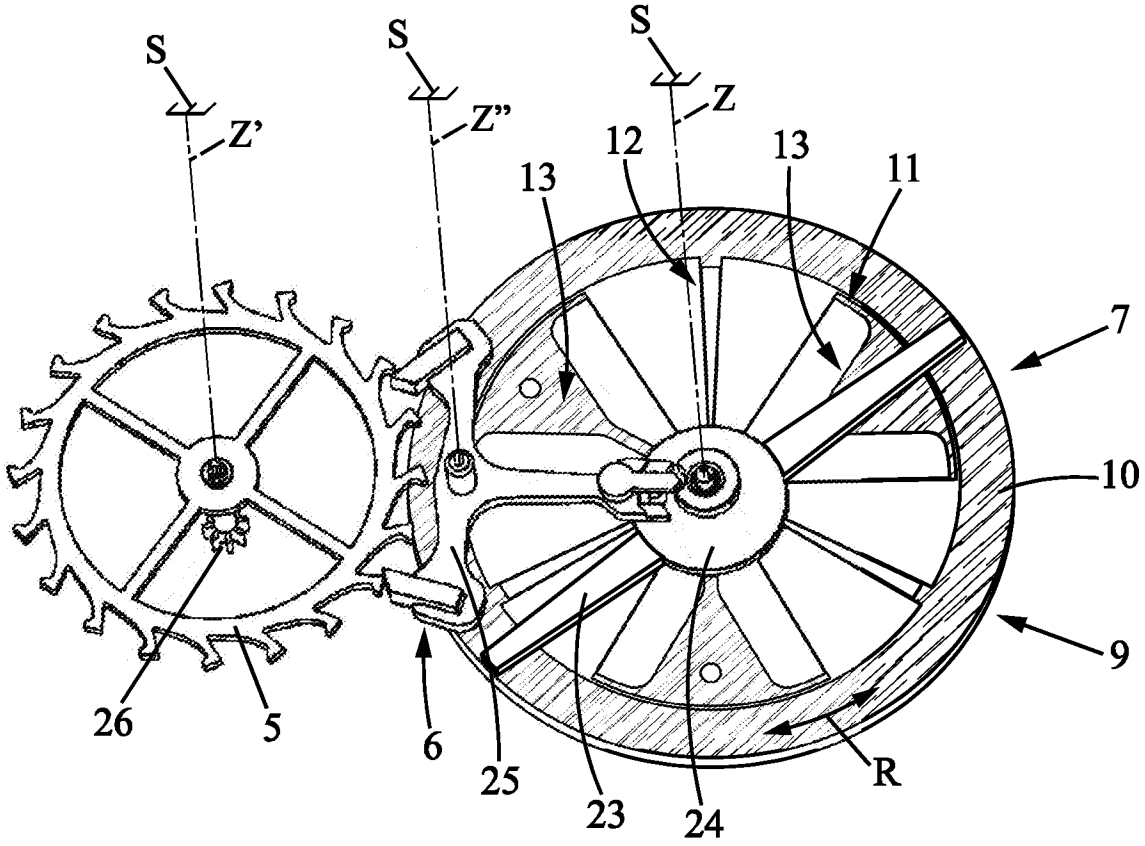
FIG. 3 shows the regulator of FIG. 2 assembled to a blocking mechanism.

As shown schematically in FIG. 3, regulator 7 may be assembled for instance to a blocking mechanism 6 in the form of a classical escapement mechanism, here a so-called Swiss-lever escapement or Swiss-anchor escapement. Just as an illustrative example, the rigid external element 10 may be connected to a bride fitting 23 bearing an impulse roller 24 cooperating with a Swiss anchor 25 which itself cooperates with the energy distribution wheel 5 in the form of an escapement wheel. The escapement wheel 5 is connected to a pinion 26 meshing with one of the pinions of transmission 3. Both escapement wheel 5 and pinion 26 rotate on a rotation axis Z' (fixed with respect to the above-mentioned support S) parallel to axis Z, and the Swiss anchor 25 pivots in alternating movements on a pivoting axis Z" (also fixed with respect to the above-mentioned support S) parallel to axis Z. The structure and operation of these elements is well known in the field of clock making and will not be detailed. Other blocking mechanisms 6 and energy distribution wheels 5 are possible.

Figure 4:
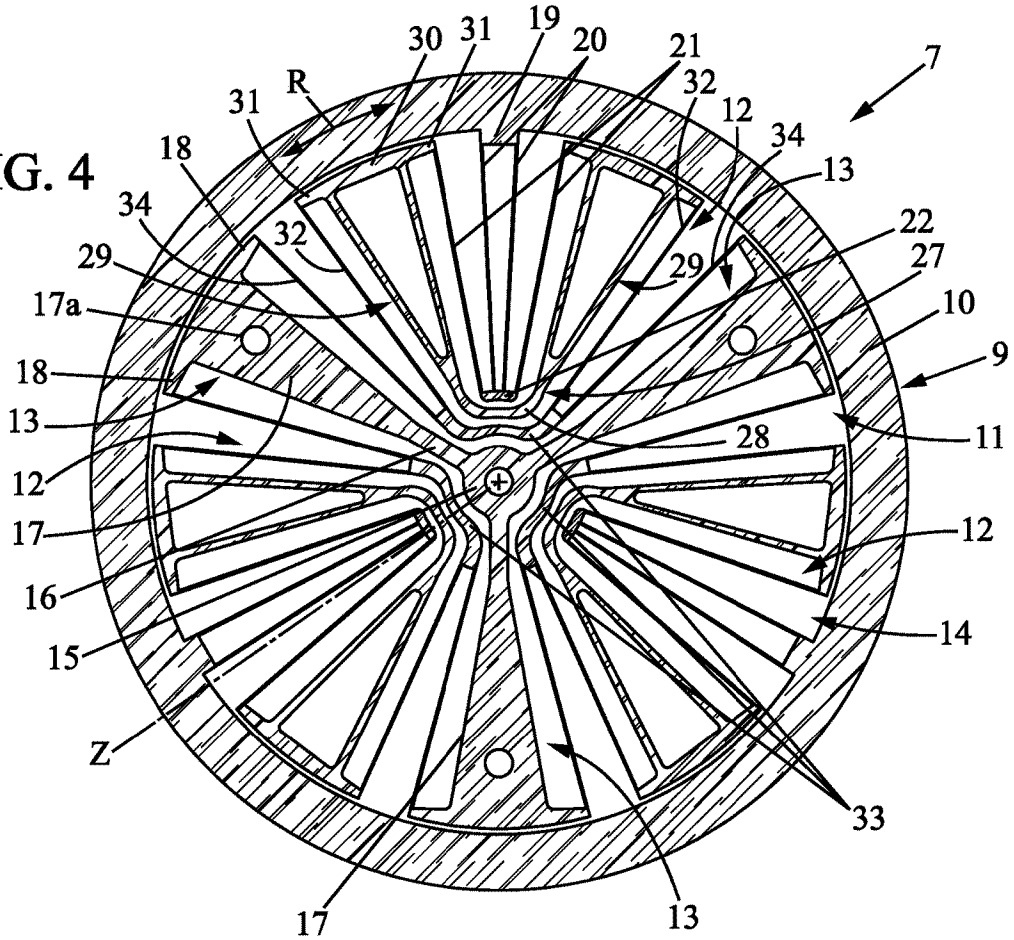
FIGS. 4 and 5 are views similar to FIG. 2, for second and third embodiments of the invention.
Figure 5:
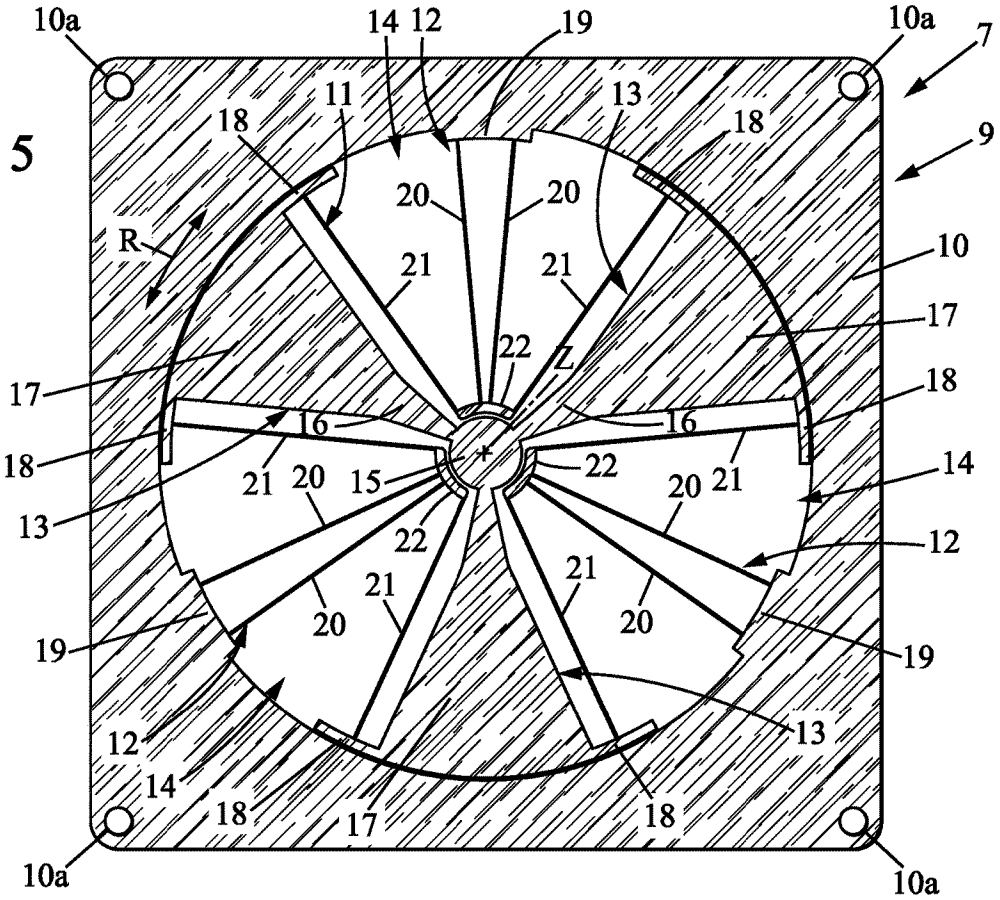

The embodiments of FIGS. 4 and 5 are similar to that of FIG. 2 and will thus not be described in details. All description and advantages of the first embodiment apply to these embodiments of FIGS. 4 and 5 except if specified otherwise hereunder.

The embodiment of FIG. 4 differs from that of FIG. 2 by the elastic suspensions 12, which comprise more elastic branches to enhance linearity for higher oscillation amplitudes. In the case of FIG. 4, each elastic suspension 12 comprises at least one first elastic branch 20 similar to that of FIG. 2 (e.g. two first elastic branches), at least two second elastic branches 21 similar to that of FIG. 2, at least two third elastic branches 32 and at least two fourth elastic branches 34. All the elastic branches extend substantially radially with regard to axis Z.

The first elastic branches 20 have an outer end connected to the external rigid element 10 and for instance to one of the protrusions 19, and an inner end connected to a first rigid intermediate element 22 separate from the internal rigid element and similar to the above described rigid intermediate element 22.

The two second elastic branches 21 having inner ends connected to said first intermediate rigid element 22 and outer ends connected respectively to two outer arms of a V-shaped second rigid intermediate element 27.

Said second rigid intermediate element 27 is separate from the internal rigid element 11 and from the first rigid intermediate element 22.

Said second rigid intermediate element 27 has a base 28 disposed between the first rigid intermediate element 22 and the axis of rotation Z and two outwardly diverging rigid V-shaped arms 29 rigidly connected to the base 28. The V-shaped arms 29 may be hollowed out in their center, to reduce the mass of internal rigid element 11.

Each arm 29 may have a head 30 close to the inner rim of the external rigid element 10. The head 30 may have opposed lateral extensions 31 which extend respectively toward the adjacent protrusion 19 and the adjacent lateral extension 18.

The two third elastic branches 32 have outer ends connected to said second intermediate rigid element 27, for instance to the lateral extension 31 close to the adjacent lateral extension 18. The two third elastic branches 32 also have inner ends connected respectively to a third rigid intermediate element 33. Said third rigid intermediate element 33 is separate from the internal rigid element 11 and from the first rigid intermediate elements 22 and second rigid intermediate element 27.

The third rigid intermediate element 33 is disposed between the basis 28 of the second rigid intermediate element 27 and the axis of rotation Z. The third rigid intermediate element 33 is disposed close to the outer rim of hub 15.

The two fourth elastic branches 34 have inner ends connected to said third intermediate rigid element 3 and outer ends connected respectively to adjacent arms 13 of the internal rigid element. The outer ends of the two fourth elastic branches 34 may in particular be connected to the lateral extensions 18 of arms 13.

In a particular example of the embodiment of FIG. 4, regulator 7 may exhibit the following properties:

- material of plate 9: silicon;
- thickness of plate 9: 0.525 mm;
- inner diameter of rigid external element 10: 24 mm;
- outer diameter of rigid external element 10: 29 mm;
- width of elastic branches 20, 21: 0.024 mm;
- rotational stiffness of the regulator: $k_r=1.10\ 10^{-4}$ Nm/rad;
- minimum off-axis stiffness $k_{oa}$ of the regulator: 274 N/m.

The embodiment of FIG. 5 distinguishes from that of FIG. 2 by the fact that the external rigid element 10 is designed to be fixed to the support S (for instance by screws or similar through holes 10*a* of external rigid element 10) and the internal rigid element 11 is designed to pivot in free oscillations. The arms 13 of internal rigid element 11 are therefore larger to enhance rotational inertia of the internal rigid element 11.

In case a blocking mechanism 6 similar to that of FIG. 3 is used with the regulator of FIG. 5, then the impulse roller 24 is be fixed to the internal rigid element 11, directly or through a fitting.

In the above-described embodiments, the monolithic timepiece regulator 7 has three elastic suspensions 12 regularly distributed angularly at 120° from each other around the axis of rotation Z. More generally, the monolithic timepiece regulator 7 may have at least three elastic suspensions 12 regularly distributed angularly at 120° from each other around the axis of rotation Z. This disposition is particularly advantageous to reduce the off-axis drift in all directions in the plane of plate 9, so that the centre of mass of the moving portion (either external rigid element 10, or internal rigid element 11) will remain substantially the same during rotation. It causes the system to become "force balanced" for a rotational motion. This is particularly useful because, for purposes of enhancing linearity of the oscillating system, the elastic suspensions 12 are usually individually soft, but the overall off-axis stiffness (i.e. stiffness with respect to shifting movements in the plane of plate 9) is relatively high, thus making the design of regulator 7 more robust against acceleration, gravity influences and shocks. Besides, having 3 elastic suspensions enables to have a large amplitude of rotational oscillations.

Generally, regulator 7 may have an off-axis stiffness $k_{oa}$ of at least 60 N/m, preferably about 65 N/m or more.

Also, regulator 7 may generally have a rotational stiffness $k_r$ of at most 5 $10^{-4}$ Nm/rad, preferably less than 2 $10^{-4}$ Nm/rad and even more preferably less than 1.5 $10^{-4}$ Nm/rad.

In all embodiments, the energy P per stroke of the regulator mechanism 7 is preferably at least 20 $10^{-6}$ W (20 micro Watt), preferably at least 40 $10^{-6}$ W. This energy per stroke P is calculated as follows:

$P=E\cdot f$, where E is the total potential energy of the regulator mechanism 7 and f is the frequency of oscillation;

$E=0.5\cdot k_r\cdot\theta^2$, where θ is the amplitude of oscillation.

The invention claimed is:

1. A monolithic timepiece regulator made in a single plate, comprising:

an external rigid element, an internal rigid element surrounded by said external rigid element, a plurality of elastic suspensions connecting the external rigid clement to the internal rigid element and enabling oscillating rotational movements between the external rigid element and the internal rigid element, around an axis of rotation which is perpendicular to the plate, wherein the internal rigid element comprises a plurality of arms which are rigidly connected with one another, said arms being distributed around the rotation axis and leaving between them free angular spaces which are radially external to the internal rigid element, the elastic suspensions being respectively located in said free angular spaces.

2. The monolithic timepiece regulator according to claim 1, wherein said plurality of elastic suspensions includes at least three elastic suspensions and said plurality of arms includes at least three arms.

3. The monolithic timepiece regulator according to claim 1, wherein said plurality of elastic suspensions consists in three elastic suspensions and said plurality of arms consists in three arms.

4. The monolithic timepiece regulator according to claim 1, wherein said elastic suspensions are regularly distributed angularly around the axis of rotation.

5. The monolithic timepiece regulator according to claim 1, wherein said internal rigid element further includes a rigid hub, said arms of the internal rigid element extending each from said hub to an outer end relatively close to the external rigid element.

6. The monolithic timepiece regulator according to claim 1, wherein each elastic suspension includes a plurality of elastic branches which are disposed substantially radially with regard to the axis of rotation and which extend each between an inner end and an outer end, said elastic branches being connected together either at their respective inner ends, or at their respective outer ends.

7. The monolithic timepiece regulator according to claim 1, wherein each elastic suspension comprises at least one first elastic branch and at least two second elastic branches, said first elastic branch having an outer end connected to the external rigid element and an inner end connected to a rigid intermediate element separate from the internal rigid element, the two second elastic branches having inner ends connected to said intermediate rigid element and outer ends connected respectively to two adjacent arms of the internal rigid element.

8. The monolithic timepiece regulator according to claim 1, wherein each elastic suspension comprises at least one first elastic branch, at least two second elastic branches, at least two third elastic branches and at least two fourth elastic branches, said first elastic branch having an outer end connected to the external rigid element and an inner end connected to a first rigid intermediate element separate from the internal rigid element, the two second elastic branches having inner ends connected to said first intermediate rigid element and outer ends connected respectively to two outer arms of a V-shaped, second rigid intermediate element, said second rigid intermediate element being separate from the internal rigid element and from the first rigid intermediate element and having a base disposed between the first rigid intermediate element and the axis of rotation, the two third elastic branches having outer ends connected to said second intermediate rigid element and inner ends connected respectively to a third rigid intermediate element, said third rigid intermediate element being separate from the internal rigid element and from the first and second rigid intermediate elements and being disposed between the second rigid intermediate element and the axis of rotation, the two fourth elastic branches having inner ends connected to said third intermediate rigid element and outer ends connected respectively to adjacent arms of the internal rigid element.

9. The monolithic timepiece regulator according to claim 1, wherein the arms of the inner rigid element are T shaped and include an outer head extending in a substantially angular direction relative to the axis of rotation, said outer head having two ends connected respectively to outer ends of two elastic branches of two adjacent elastic suspensions.

10. The monolithic timepiece regulator according to claim 1, having an off-axis stiffness of at least 60 N/m.

11. The monolithic timepiece regulator according to claim 1, having a rotational stiffness of at most 5 $10^{-4}$ Nm/rad.

12. A timepiece movement having the monolithic timepiece regulator according to claim 1.

13. The timepiece movement according to claim 12, wherein the internal rigid element is fixed to a support and the external rigid element is free to oscillate around the axis of rotation, with respect to the support.

14. The timepiece movement according to claim 12, wherein the external rigid element is fixed to a support and the internal rigid element is free to oscillate around the axis of rotation, with respect to the support.

15. The timepiece movement according claim 12, wherein one of the internal and external rigid elements is fixed to a support and the other one of the internal and external rigid elements is a regulating member which is free to oscillate around the axis of rotation, the timepiece movement further comprising a blocking mechanism which is controlled by the regulating element to regularly and alternatively hold and release a rotary energy distribution wheel so that said energy distribution wheel rotates by rotational steps, of a constant angular travel at each rotational step, said blocking mechanism being further adapted to regularly release energy to the regulating member for maintaining oscillation of said regulating member.

16. A timepiece having the timepiece movement according to claim 12.

* * * * *